US011480891B2

(12) United States Patent
Iwaki et al.

(10) Patent No.: US 11,480,891 B2
(45) Date of Patent: Oct. 25, 2022

(54) IMAGE FORMING APPARATUS

(71) Applicant: FUJIFILM BUSINESS INNOVATION CORP., Tokyo (JP)

(72) Inventors: Kaori Iwaki, Kanagawa (JP); Yosuke Tashiro, Kanagawa (JP); Kaoru Yamauchi, Kanagawa (JP); Toshifumi Takahira, Kanagawa (JP); Masahiko Kubo, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/910,341

(22) Filed: Jun. 24, 2020

(65) Prior Publication Data

US 2021/0286287 A1 Sep. 16, 2021

(30) Foreign Application Priority Data

Mar. 12, 2020 (JP) ..... JP2020-043240

(51) Int. Cl.

| | |
|---|---|
| ***G03G 15/08*** | (2006.01) |
| ***G03G 15/20*** | (2006.01) |
| ***G03G 15/01*** | (2006.01) |
| ***G03G 9/08*** | (2006.01) |

(52) U.S. Cl.

CPC ..... *G03G 15/0822* (2013.01); *G03G 9/08* (2013.01); *G03G 15/0126* (2013.01); *G03G 15/2017* (2013.01)

(58) Field of Classification Search

CPC ..... G03G 15/0822; G03G 15/0126; G03G 15/2017; G03G 9/08

See application file for complete search history.

(56) References Cited

U.S. PATENT DOCUMENTS

2014/0369723 A1* 12/2014 Takahashi ..... G03G 15/2014 399/321
2019/0079423 A1* 3/2019 Iwaki ..... G03G 15/1605

FOREIGN PATENT DOCUMENTS

JP 2016-114923 A 6/2016

* cited by examiner

*Primary Examiner* — Clayton E. LaBalle
*Assistant Examiner* — Michael A Harrison
(74) *Attorney, Agent, or Firm* — Oliff PLC

(57) ABSTRACT

An image forming apparatus includes plural image forming units and a controller. The plural image forming units are configured to form images of colors using colorants, respectively. The controller is configured to perform control such that the plural images formed by the plural image forming units are output as one image onto a recording medium. At least two of the image forming units are configured to form images using colorants of special colors, respectively and are arranged in succession.

15 Claims, 17 Drawing Sheets

AFTER SECONDARY TRANSFER

WHEN IMAGE FORMING UNIT 12WA AND IMAGE FORMING UNIT 12K ARE INTERCHANGED

WHITE TONER AS LOWERMOST LAYER

WHEN IMAGE FORMING UNIT 12WB AND IMAGE FORMING UNIT 12Y ARE INTERCHANGED

REASON WHY FIXING TEMPERATURE IS INCREASED

TONER AMOUNT 340% (240% + 100%)

TONER AMOUNT 440% (240% + 200%)

WHEN IMAGE FORMING UNIT 12WA AND IMAGE FORMING UNIT 12K ARE INTERCHANGED

CONFIGURATION EXAMPLE WHEN THREE IMAGE FORMING UNITS 12 OF WHITE TONER ARE ARRANGED IN SUCCESSION

IMAGE FORMING APPARATUS

CROSS-REFERENCE TO RELATED APPLICATIONS

This application is based on and claims priority under 35 USC 119 from Japanese Patent Application No. 2020-043240 filed Mar. 12, 2020.

BACKGROUND

1. Technical Field

The present disclosure relates to an image forming apparatus.

2. Related Art

JP-A-2016-114923 discloses an image forming apparatus in which a toner concentration of a developer in a developing device is changed in accordance with an input white toner lightness setting value to adjust a developing capacity of the developing device, and the developer is agitated for an agitation time that is determined based on a white toner replenishment amount accumulated from a time of adjusting the developing capacity and absolute humidity around the developing device.

SUMMARY

In an electrophotographic image forming apparatus, a color image may be formed using respective color toners called basic colors such as toners of C, M, Y, and K colors, a metallic toner such as a gold toner or a silver toner, or a clear toner. In particular, a white toner may be used as a base when an image is formed on a transparent film or when an image is formed on paper other than white paper.

However, when dark-colored paper such as a black sheet is used, a texture of the paper may appear even when the white toner is used as the base. Therefore, it is required to form a white image having a high hiding rate by increasing a toner amount of the white toners as much as possible.

However, when the toner amount is increased in forming the image, an image defect such as toner fog occurs during development. Thus, there is a limit of the toner amount even if the toner amount is increased.

When an image having a large toner amount is formed by overprinting, for example, a white image is first formed and then another white image is formed on the white image in a superimposed manner, a positional displacement between the two white images may occur and productivity may be poor.

Aspects of non-limiting embodiments of the present disclosure relate to an image forming apparatus capable of forming an image having a larger amount of a colorant of a special color as compared with a case where an image is formed using the colorant of the special color by only one image forming unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the disclosure, there is provided an image forming apparatus including plural image forming units and a controller. The plural image forming units are configured to form images of colors using colorants, respectively. The controller is configured to perform control such that the plural images formed by the plural image forming units are output as one image onto a recording medium. At least two of the image forming units are configured to form images using colorants of special colors, respectively and are arranged in succession.

BRIEF DESCRIPTION OF THE DRAWINGS

Exemplary embodiment(s) of the present disclosure will be described in detail based on the following figures, wherein.

DETAILED DESCRIPTION

Next, an exemplary embodiment of the present disclosure will be described with reference to the drawings.

Figure 1:
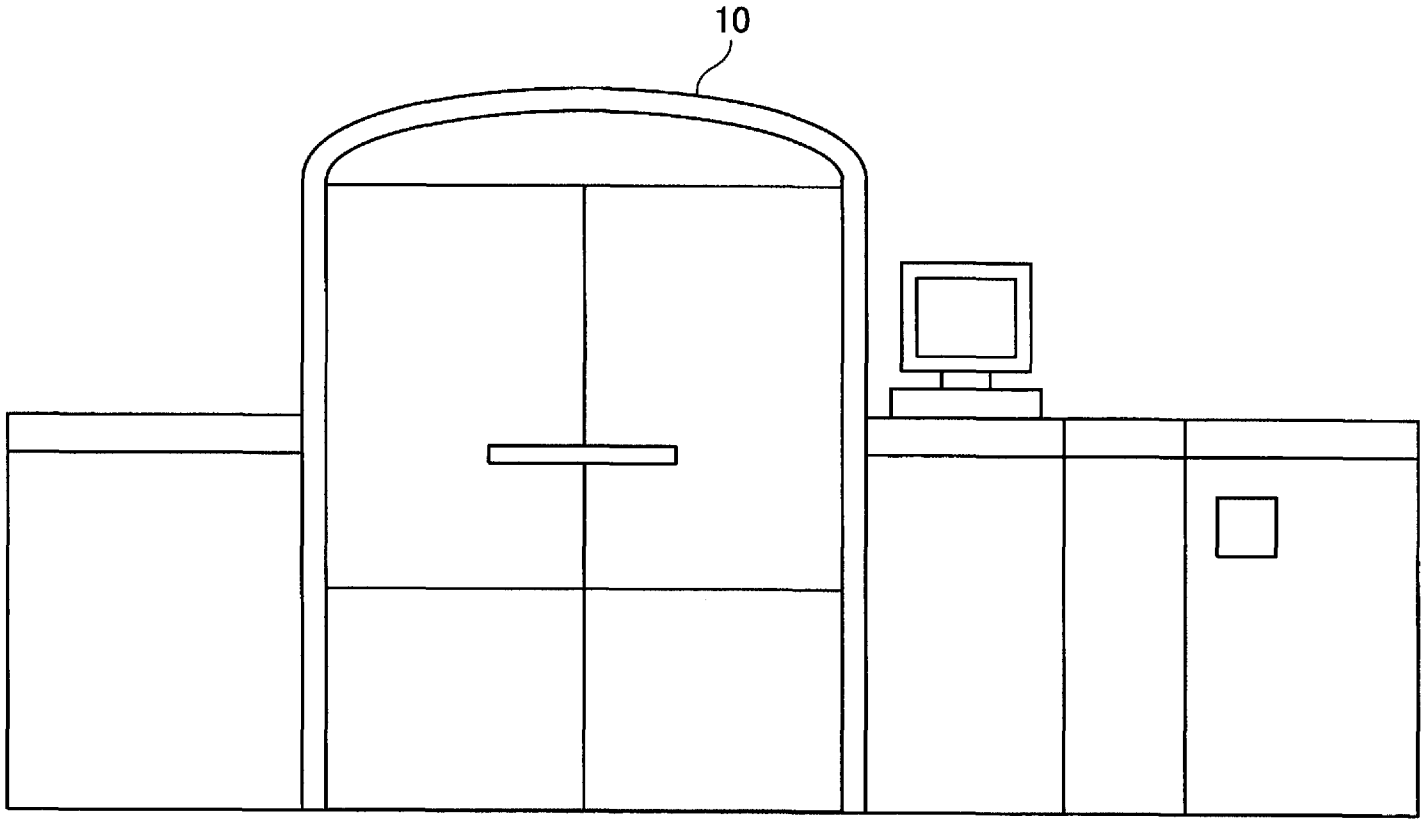
FIG. 1 is a diagram showing an external configuration of an image forming apparatus 10 according to an exemplary embodiment of the present disclosure.

FIG. 1 is a diagram showing an external configuration of an image forming apparatus 10 according to an exemplary embodiment of the present disclosure.

As shown in FIG. 1, the image forming apparatus 10 according to the exemplary embodiment is a so-called production printer for use in business printing, and has a function of executing a high-quality, high-speed printing process.

Figure 2:
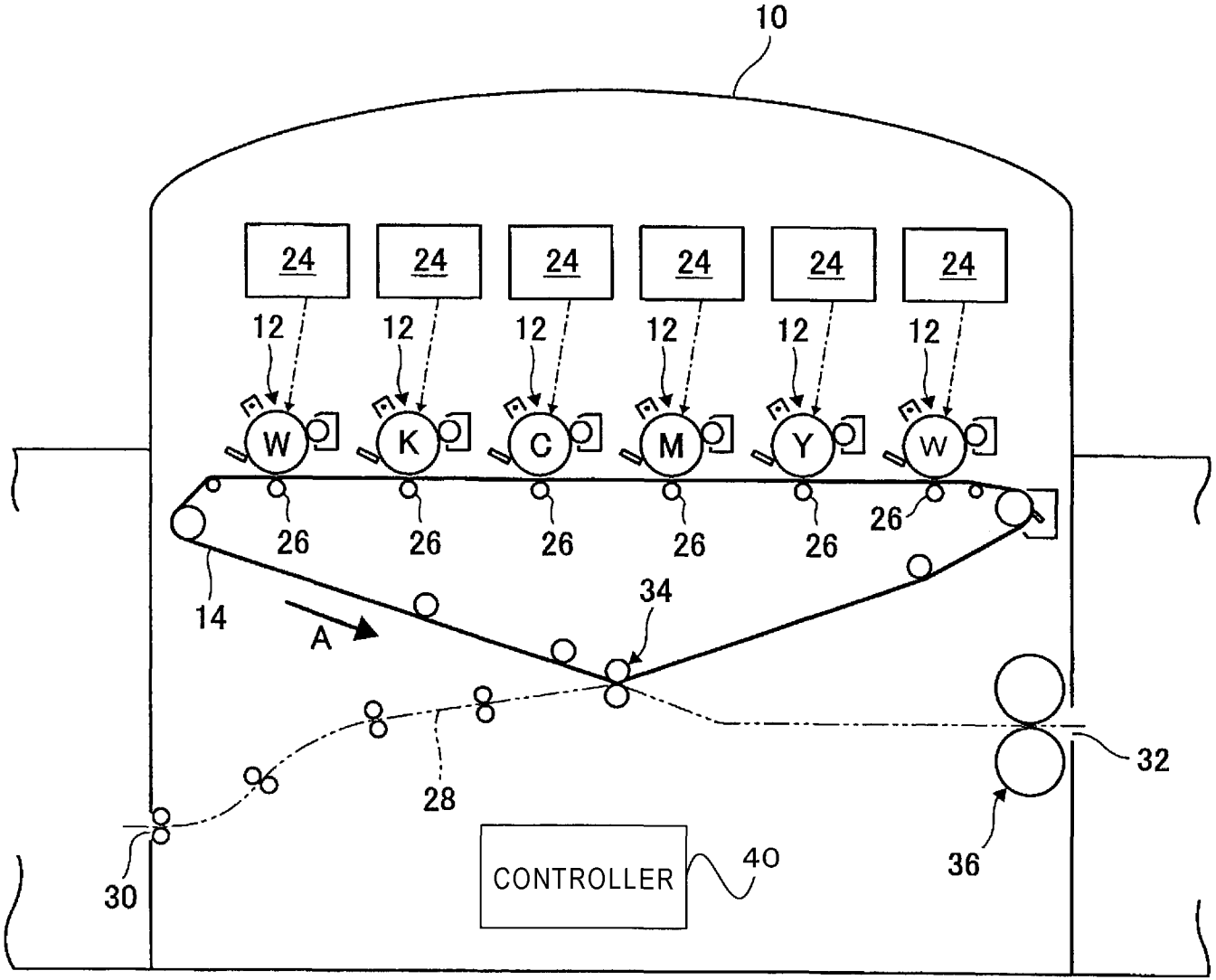
FIG. 2 is a diagram showing an internal structure of a main body of the image forming apparatus 10.

An internal structure of a main body of the image forming apparatus 10 will be described with reference to FIGS. 2 and 3. As shown in FIG. 2, the image forming apparatus 10 includes six image forming units 12. The six image forming units 12 are configured to form an image on a recording medium using basic color toners of yellow (Y), magenta (M), cyan (C), and black (K) and two special color toners, respectively.

The special color toners include a metallic (metallic luster) toner such as a silver toner (Si) or a gold toner (G), a transparent toner, and a white toner (W). It is possible to select and use two toners from these special color toners. FIG. 2 shows a case where the white toner (W) is selected from these special color toners and set at both ends of the basic color toners.

Here, a toner amount refers to an amount of toners used per unit area on a recording medium, for example, a toner weight ($g/m^2$). In the following description, a rate of an amount of each color toner used in printing is expressed by a percent value (that is, a toner coverage rate) where the maximum value of the amount of each color toner used per unit area, for example, per pixel is 100%.

Figure 3:
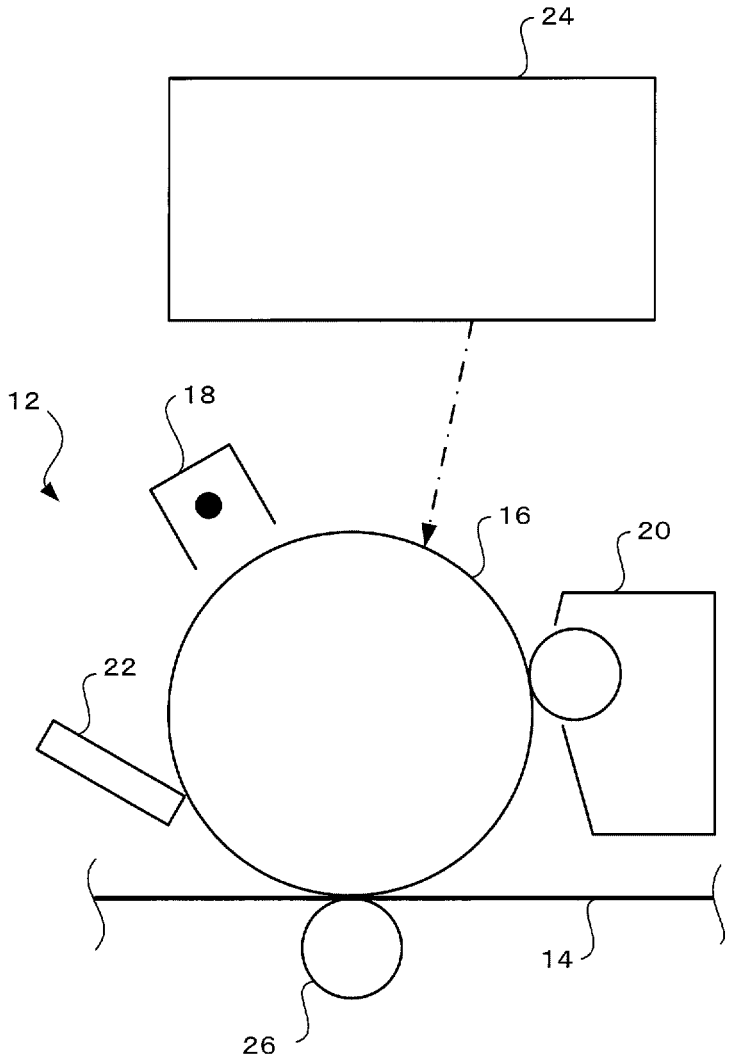
FIG. 3 is a diagram showing an image forming unit 12 of the image forming apparatus 10.

As shown in FIG. 3, the image forming unit 12 includes a photoconductor drum 16, a charging device 18, a developing device 20, and a cleaning device 22. The charging device 18 uniformly charges a surface of the photoconductor drum 16. The charging device 18 is an example of a charging unit. The developing device 20 develops an electrostatic latent image formed on the photoconductor drum 16. The photoconductor drum 16 is a cylindrical image carrier that carries a toner image (developer image). The photoconductor drum 16 is uniformly charged by the charging device 18. An electrostatic latent image is formed on the photoconductor drum 16 by a laser beam emitted from an optical scanning device 24. The electrostatic latent image formed on the photoconductor drum 16 is developed with a toner by the developing device 20 and transferred to an intermediate transfer belt 14. A residual toner and paper dust adhering to the photoconductor drum 16 are removed by the cleaning device 22 after the toner image is transferred.

The image forming unit 12 is provided close to the intermediate transfer belt 14. The intermediate transfer belt 14 is configured to rotate in a direction indicated by an arrow A in FIG. 2. That is, the intermediate transfer belt 14 is wound on plural support rollers that support the intermediate transfer belt 14 with a constant tension. Primary transfer rollers 26 are disposed at positions where the primary transfer rollers 26 face the photoconductor drums 16 with the intermediate transfer belt 14 interposed therebetween. The primary transfer rollers 26 transfer the toner images of the respective colors formed on the photoconductor drum 16 to the intermediate transfer belt 14.

A transport path 28 is formed below the intermediate transfer belt 14. The transport path 28 transports the recording medium. The transport path 28 includes plural transport rollers that transport the recording medium from a carry-in port 30 to a discharge port 32. A secondary transfer device 34 is disposed on the transport path 28 below the intermediate transfer belt 14. The secondary transfer device 34 secondarily transfers the toner images, which are primarily transferred from the photoconductor drum 16 to the intermediate transfer belt 14, to the recording medium transported on the transport path 28. A fixing device 36 is provided downstream of the secondary transfer device 34 in a recording medium transport direction. The fixing device 36 is a device that fixes the images, which are formed by the plural image forming units 12, to the recording medium by heating. The fixing device 36 fixes the toner images, which are transferred onto the recording medium, to the recording medium by heat and pressure. The recording medium on which the images are fixed by the fixing device 36 is discharged from the discharge port 32.

The image forming apparatus 10 includes a controller 40. The controller 40 controls the respective units such as the image forming units 12 to execute the printing process.

Then, when the respective color toners are set in the six image forming units 12 in an order of white (W), yellow (Y), magenta (M), cyan (C), black (K), and white toners (W) as shown in FIG. 2, the toner images are formed in a superimposed manner by being primarily transferred onto the intermediate transfer belt 14 in this order, and are collectively secondarily transferred from the intermediate transfer belt 14 to the recording medium by the secondary transfer device 34.

Figure 4:
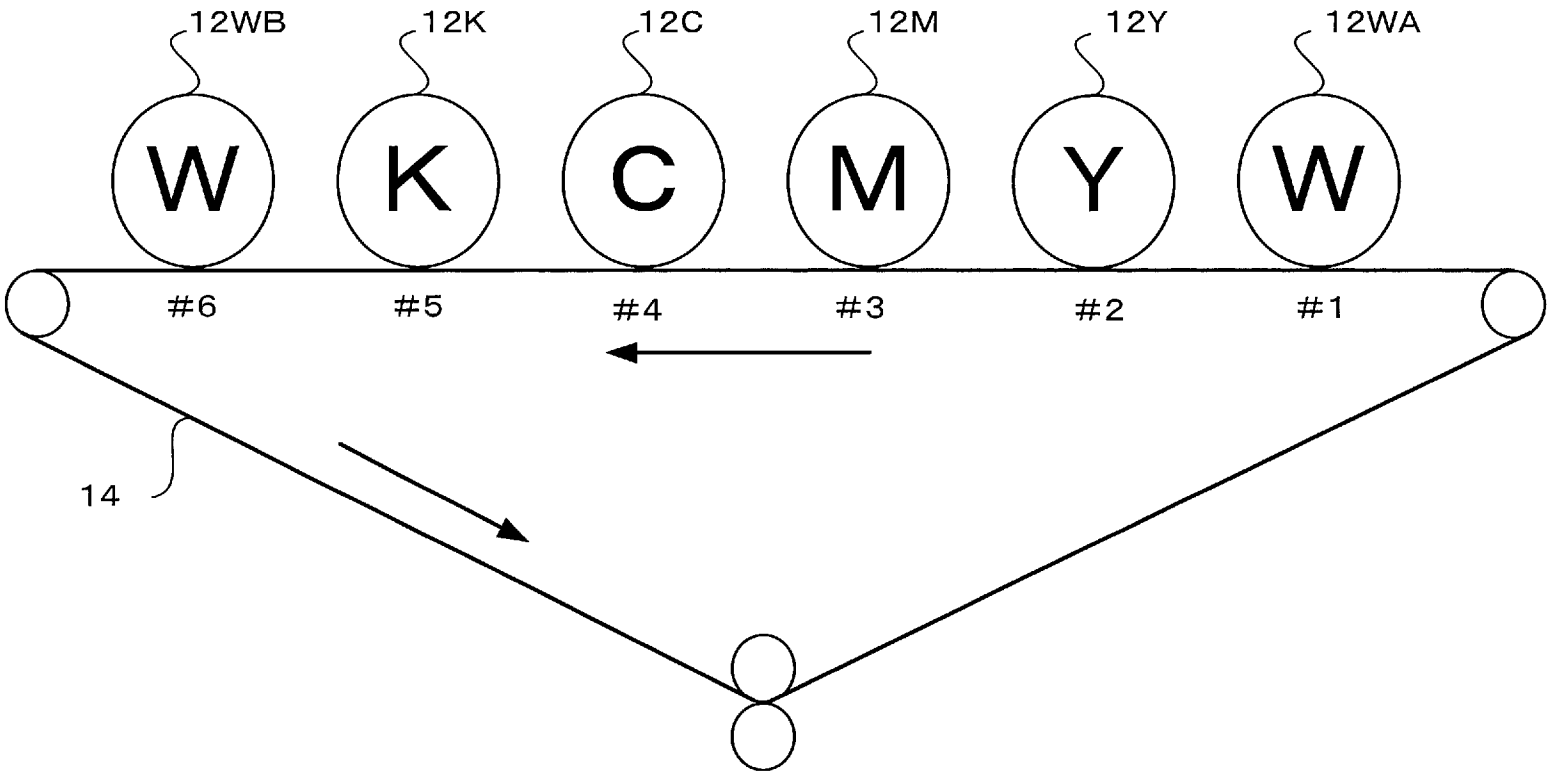
FIG. 4 is a diagram showing a positional relationship between the image forming units 12 and an intermediate transfer belt 14.

FIG. 4 shows a positional relationship between the image forming units 12 and the intermediate transfer belt 14 described above. In FIG. 4, the six image forming units 12 are shown simply as circles. In the following description, reference signs 12WB, 12K, 12C, 12M, 12Y, and 12WA are assigned to the six image forming units to distinguish them.

The image forming units 12WA and 12WB are image forming units in which the white toners are set. The image forming units 12K, 12C, 12M, and 12Y are image forming units in which toners of black, cyan, magenta, and yellow are set, respectively.

Reference signs #1 to #6 are assigned to positions where the image forming units 12WB, 12K, 12C, 12M, 12Y, and 12WA are currently located.

Here, the image forming units 12WB, 12K, 12C, 12M, 12Y, and 12WA have the same structure, and can be detached from the image forming apparatus 10 and interchanged with other image forming units.

Next, a vertical relationship between the images formed by the six image forming units 12WB, 12K, 12C, 12M, 12Y, and 12WA will be described.

Figure 5A:
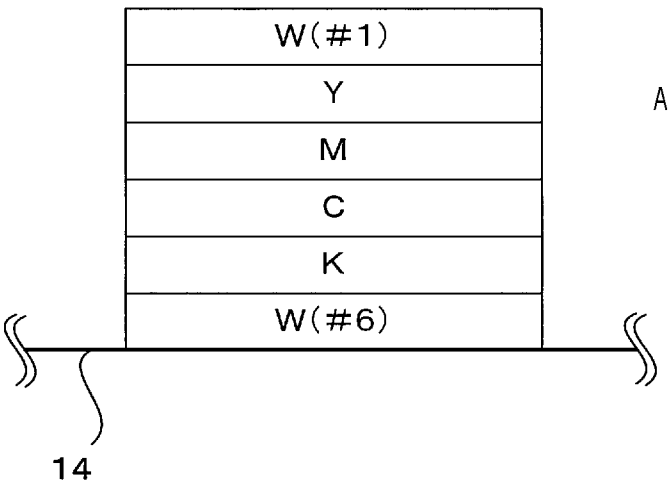
FIG. 5A is a diagram showing a state of the intermediate transfer belt 14 when images are formed in a superimposed manner by all of six image forming units 12WB, 12K, 12C, 12M, 12Y, and 12WA.

Here, FIG. 5A shows a state of the intermediate transfer belt 14 when images are formed in a superimposed manner by all of the six image forming units 12WB, 12K, 12C, 12M, 12Y, and 12WA. Referring to FIG. 5A, it can be seen that the toner images of the respective colors are superimposed on the intermediate transfer belt 14 in an order of white (W(#6)), black (K), cyan (C), magenta (M), yellow (Y), and white (W(#1)). Here, W(#6) denotes a toner image formed by the image forming unit 12WB disposed at the position #6, and W(#1) denotes a toner image formed by the image forming unit 12WA disposed at the position #1.

Figure 5B:
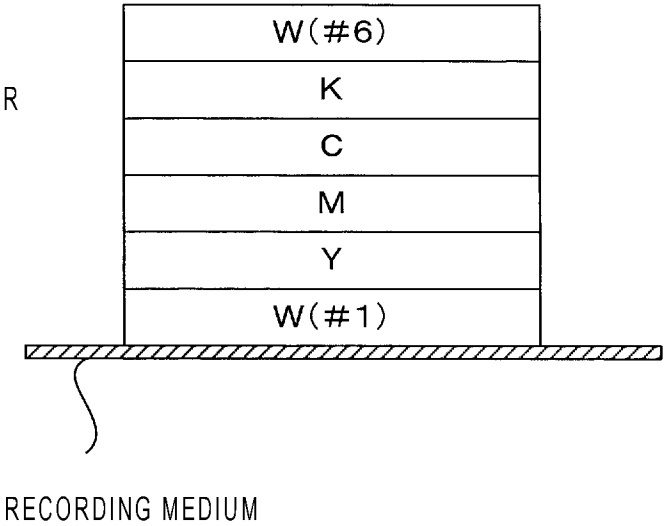
FIG. 5B is a diagram showing a state in which toner images of respective colors formed in order shown in FIG. 5A are secondarily transferred onto a recording medium.

Then, the toner images of the respective colors formed in the order shown in FIG. 5A are secondarily transferred onto the recording medium by the secondary transfer device 34, so that the toner images are turned upside down and formed on the recording medium in an order shown in FIG. 5B.

Here, when both images of the white toners W(#1) and W(#6) are formed, the image of the basic colors are invisible. Therefore, either one of the white toners W(#1) and W(#6) is normally used depending on a type of the used recording medium.

Figure 6:
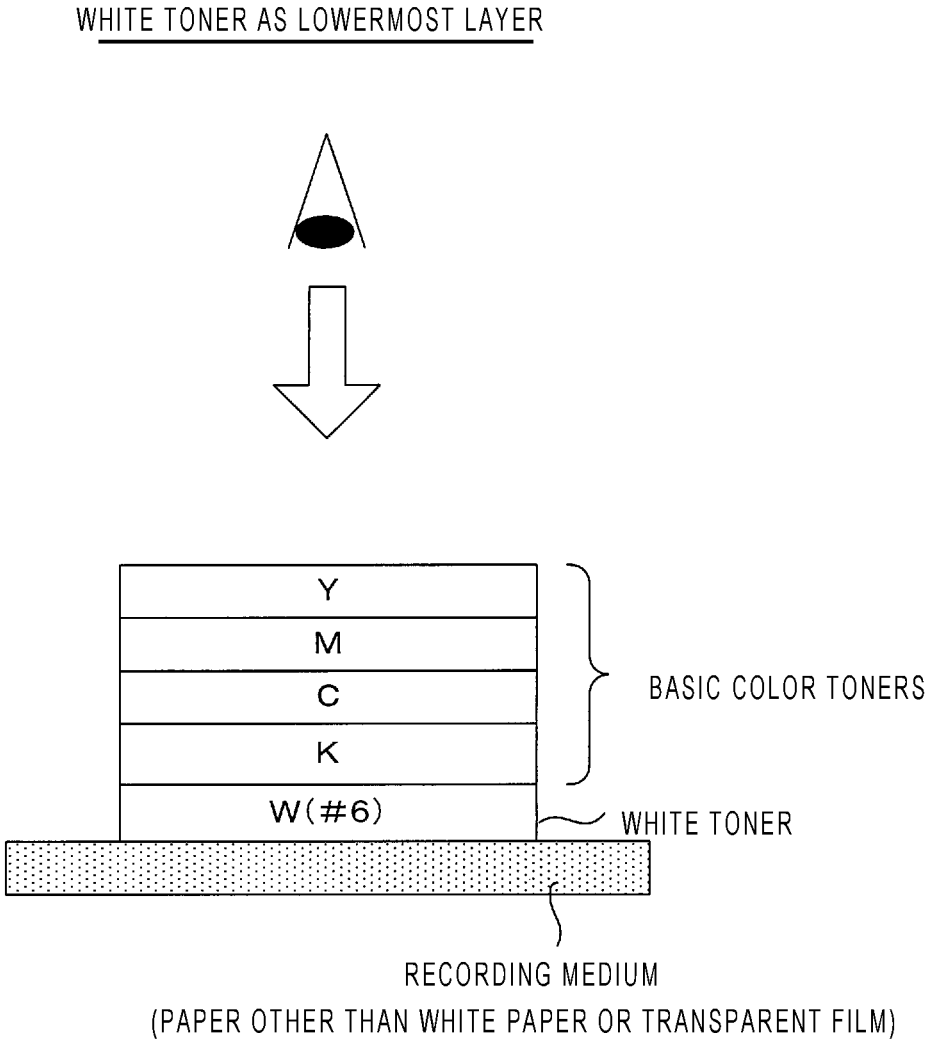
FIG. 6 is a diagram showing a state in which images are formed on the recording medium with a white toner image being located in the lowermost layer because of an arrangement order of the image forming units 12 shown in FIG. 4.

For example, when an image is formed on a recording medium such as black paper other than white paper or a transparent film, an image is formed simply using the white toner W(#6), as shown in FIG. 6.

In the case shown in FIG. 6, the images of the respective colors are formed in the superimposed manner on the recording medium in an order of the white toner (W(#6)), black (K), cyan (C), magenta (M), and yellow (Y). The white toner (W(#6)) is located in the lowermost layer. Therefore, when the toner images of the respective colors are formed in the order shown in FIG. 6, even if the recording medium is paper other than white paper or a transparent film, the white toner image hides an effect of a color of the recording medium or a color of an object behind the recording medium. As a result, an original tint of the images formed with the basic color toners is maintained. The transparent film is an example of a recording medium that allows toner images formed on one side of the recording medium to be visible from the other side of the recording medium.

Figure 7:
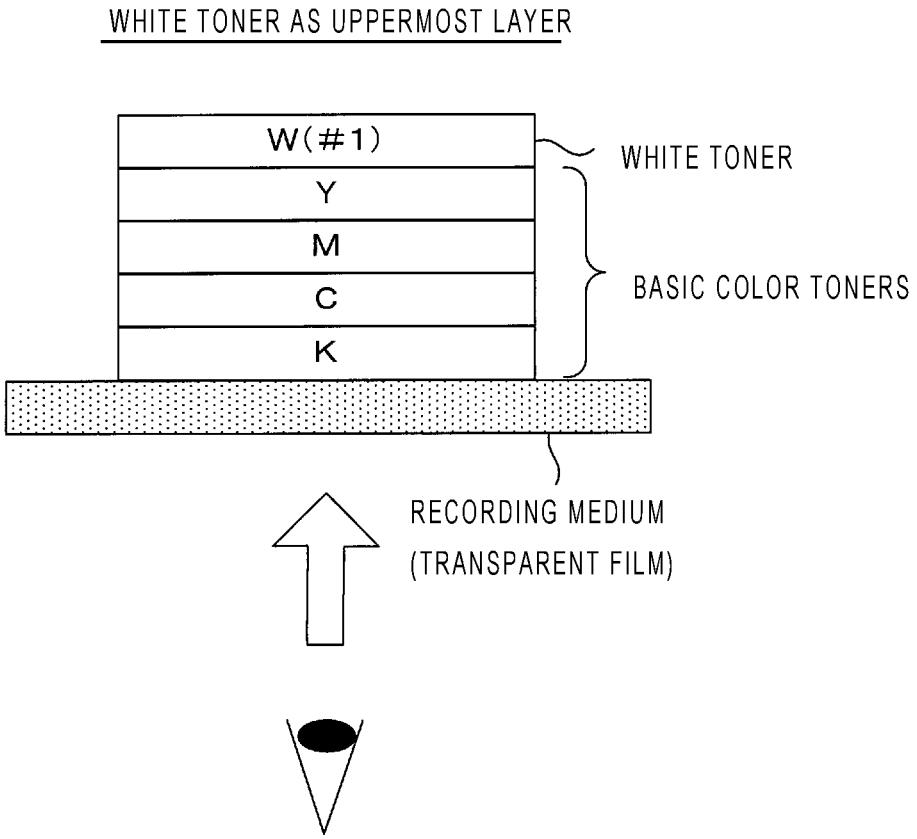
FIG. 7 is a diagram showing a state in which images are formed on the recording medium with the white toner image being located the uppermost layer because of the arrangement order of the image forming units 12 shown in FIG. 4.

FIG. 7 shows a state in which images are formed in such a way that the toner images formed on one side of a recording medium such as a transparent film is visible through the transparent film from the other side of the recoding medium.

FIG. 7 shows a case where the images are formed using the white toner (W(#1)) and the toners of the basic colors CMYK without using the white toner (W(#6)). In FIG. 7, the images of the respective colors are formed in the superimposed manner on the recording medium in an order of black (K), cyan (C), magenta (M), yellow (Y), and the white toner (W(#1)). That is, the image of the white toner (W(#1)) is formed on the recording medium as the uppermost layer. The formed images are visible from the opposite side to the side of the recording medium on which the toner images are formed.

Therefore, when the toner images of the respective colors are formed in the order shown in FIG. 7, even if the images formed with the basic color toners are visible through the recording medium such as a transparent film, the white toner image hides an effect of a color of an object behind. As a result, an original tint of the images formed with the basic color toners is maintained.

As shown in FIGS. 6 and 7, even when the two image forming units 12WA and 12WB in which the white toner is set are provided, either one of the two image forming units 12WA and 12WB is used in actually forming images because of the arrangement shown in FIG. 4.

Figure 8:
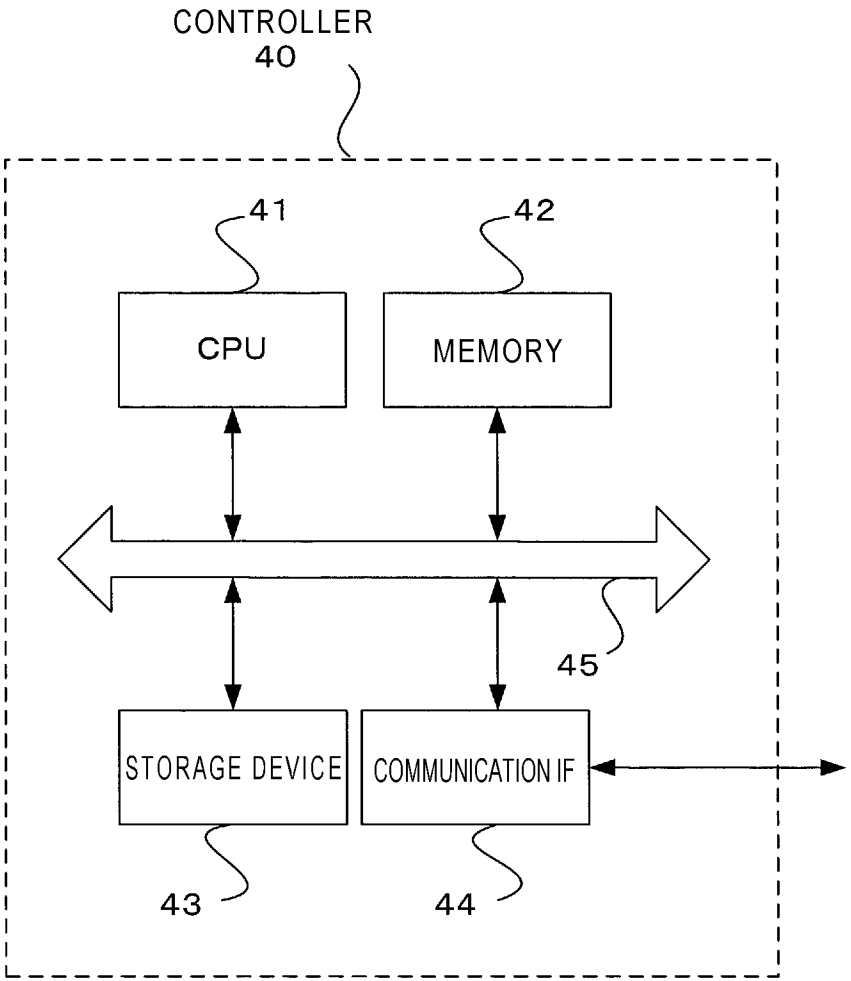
FIG. 8 is a diagram showing a hardware configuration of a controller 40 shown in FIG. 2.

Next, a hardware configuration of the controller 40 shown in FIG. 2 will be described with reference to FIG. 8. As shown in FIG. 8, the controller 40 includes a CPU 41, a memory 42, a storage device 43 such as a hard disk drive, a communication interface (IF) 44 that transmits and receives data to and from an external device and the like, and a user interface (UI) device 45 including a touch panel or a liquid crystal display, and a keyboard. These elements are connected to each other via a control bus 46.

The CPU 41 is a processor that executes a predetermined process based on a control program stored in the memory 42 or the storage device 43 to control an operation of the image forming apparatus 10. In the exemplary embodiment, the CPU 41 is described as one that reads and executes the control program stored in the memory 42 or the storage device 43. Alternatively, the program may be stored in a storage medium such as a CD-ROM and be provided to the CPU 41.

With such a configuration, the controller 40 controls the plural image forming units 12 that form the images for the respective colors using the toners and performs control such the plural images formed by the image forming units 12 to be output as one image onto the recording medium. The toners are an example of colorants.

In the image forming apparatus 10 according to the exemplary embodiment, the image forming units 12 are interchanged in order to form an image having a large amount of the white toner and to improve a hiding rate of the white image.

Figure 9:
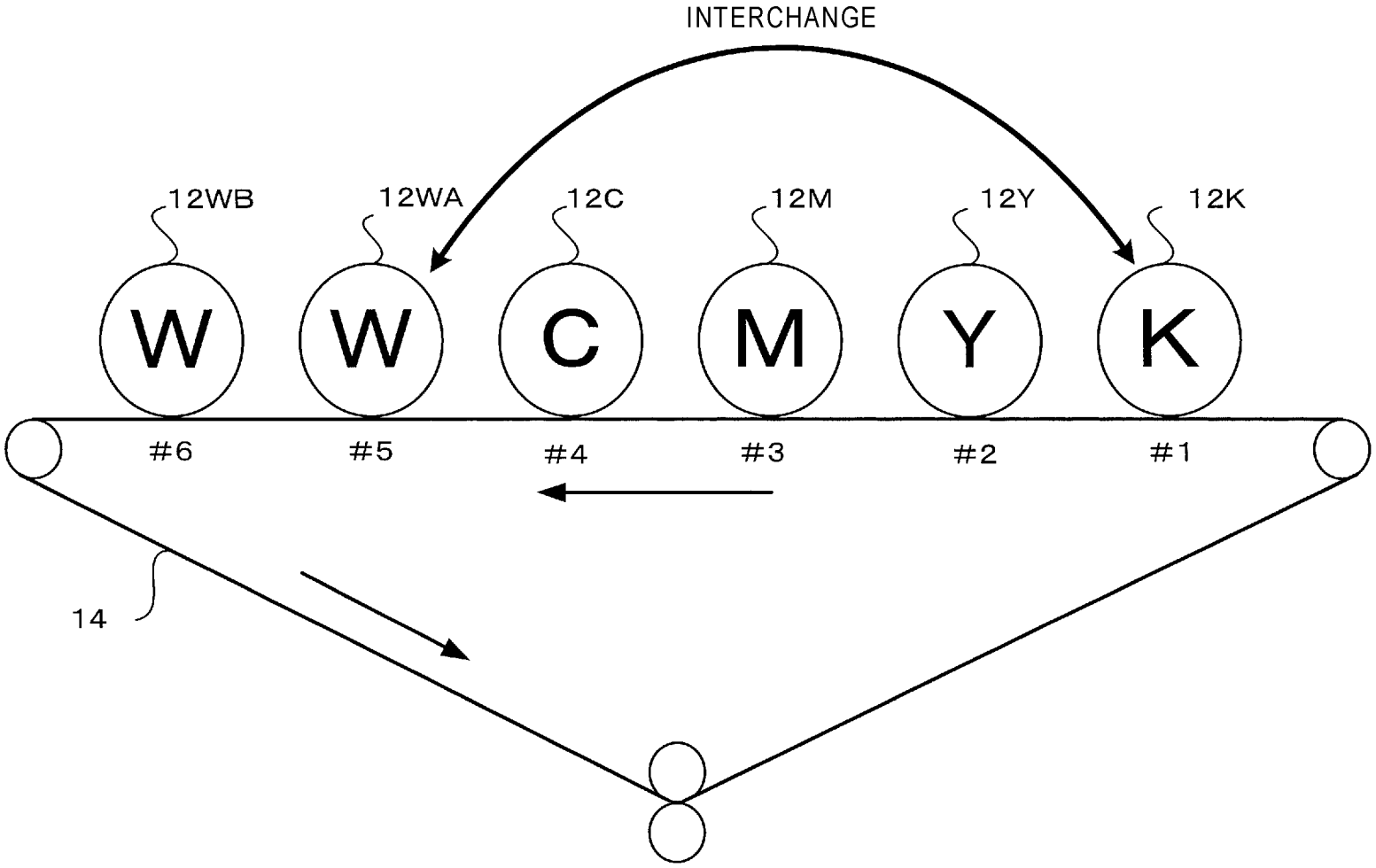
FIG. 9 is a diagram showing a configuration when the image forming unit 12WA and the image forming unit 12K are interchanged among the image forming units 12 which are arranged as shown in FIG. 4.

Specifically, as shown in FIG. 9, the image forming unit 12WA and the image forming unit 12K are interchanged among the image forming units 12 which are arranged as shown in FIG. 4.

By interchanging the image forming units 12 in this manner, the two image forming units 12WA and 12WB that form images using the white toner, among the six image forming units 12, are arranged in succession.

In the exemplary embodiment, a configuration in which at least two image forming units 12 that form images using special color toner are arranged in succession is implemented by interchanging at least a part of the plural image forming units 12 which are arranged in a predetermined arrangement order. However, a method for providing the configuration in which the at least two image forming units that form the images using the special color toner are arranged in succession is not limited to the interchanging of the image forming units in the above described manner. An image forming apparatus may be used which is configured such that at least two image forming units of special colors are arranged in succession from the beginning without interchanging any of the image forming units.

The phrase "the two image forming units of the special colors are arranged in succession" refers to that an image forming unit of another color is not disposed between the two image forming units of the special colors.

Figure 10:
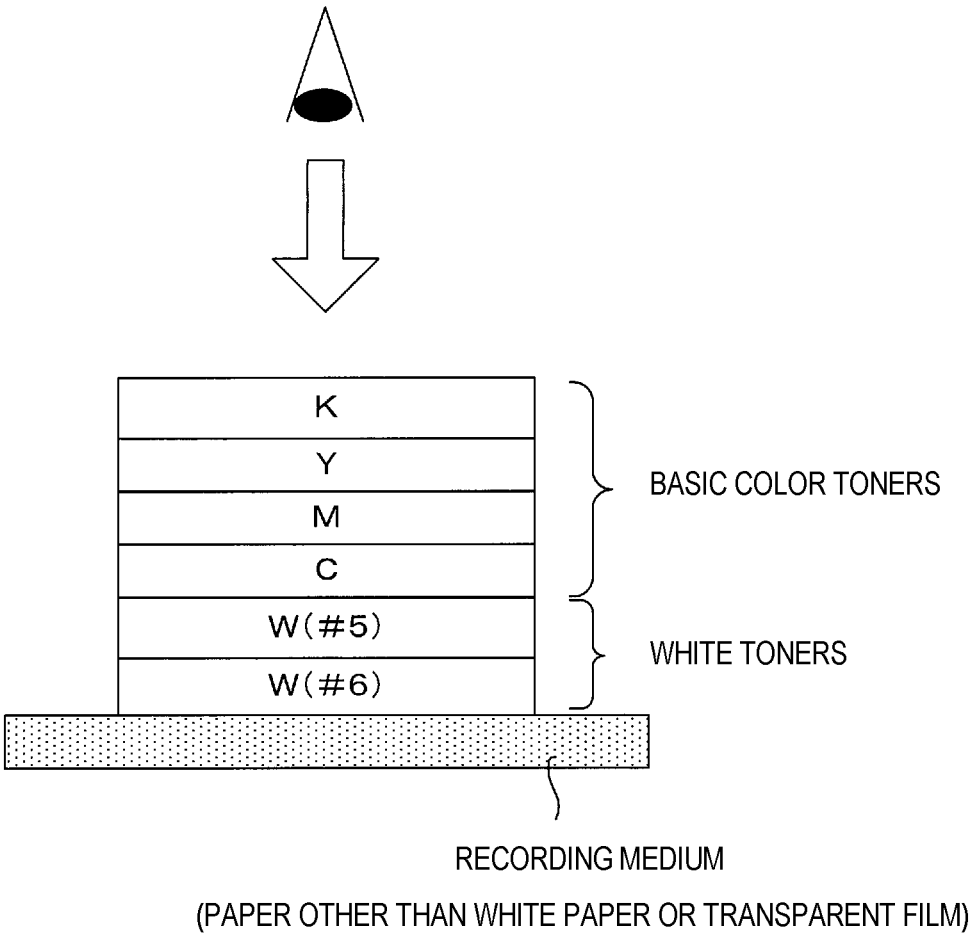
FIG. 10 is a diagram showing a state in which images are formed using the image forming units 12 which are arranged as shown in FIG. 9.

Here, the arrangement of the image forming units 12 shown in FIG. 9 is an arrangement when the white toner is formed as the lowermost layer. FIG. 10 shows a state in which images are formed using the image forming units 12 which are arranged as shown in FIG. 9.

In FIG. 10, the images of the respective colors are formed in the superimposed manner on the recording medium in an order of the white toner (W(#6)), a white toner (W(#5)), black (K), cyan (C), magenta (M), and yellow (Y). The two special color toners, that is, the white toner (W(#6)) and the white toner (W(#5)) are located in the lowermost layer.

Therefore, when the maximum toner amount in forming an image by one image forming unit 12 is 100%, a total toner amount of the white toner images respectively formed by the two image forming units 12WA and WB is 200%.

When an attempt is made to increase the toner amount of an image formed by one image forming unit, various image defects such as toner fog are more likely to occur as the toner amount increases. Therefore, it is considered that it is actually difficult to form an image having such a toner amount of 200% by one image forming unit.

However, by adopting the structure in which the two image forming units 12WA and 12WB in which the white toner is set are arranged in succession as in the image forming apparatus 10 according to the exemplary embodiment, it is possible to achieve the white toner image having the toner amount of 200% without image defects.

Next, a case where the white toner image is formed as the uppermost layer will be described.

Figure 11:
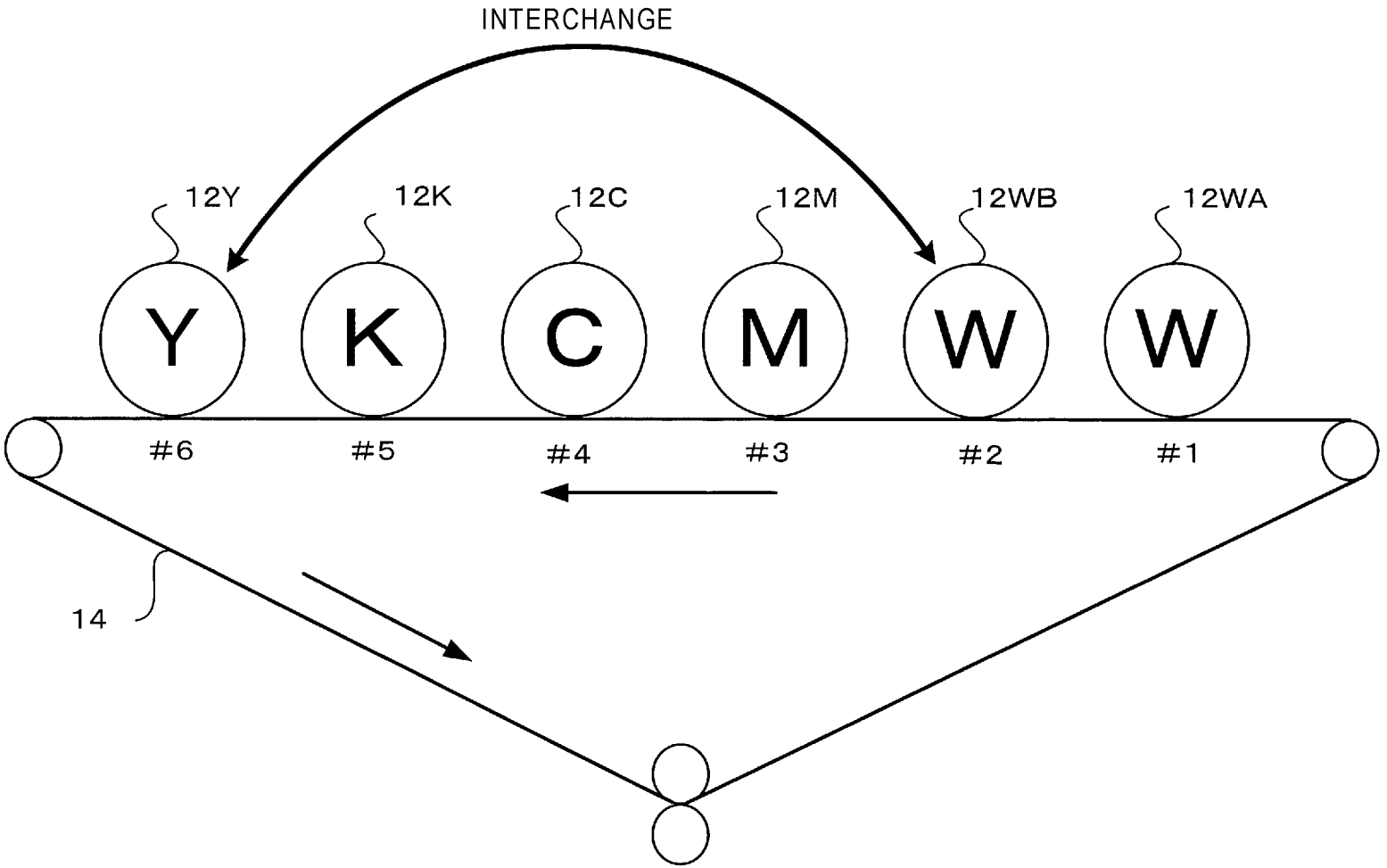
FIG. 11 is a diagram showing a configuration when the image forming unit 12WB and the image forming unit 12Y are interchanged among the image forming units 12 which are arranged as shown in FIG. 4.

As shown in FIG. 11, when the white toner image is formed as the uppermost layer, the image forming unit 12WB and the image forming unit 12Y are interchanged among the image forming units 12 which are arranged as shown in FIG. 4.

By interchanging the image forming units 12 in this manner, the two image forming units 12WA and 12WB that form the images using the white toner, among the six image forming units 12, are arranged in succession.

Figure 12:
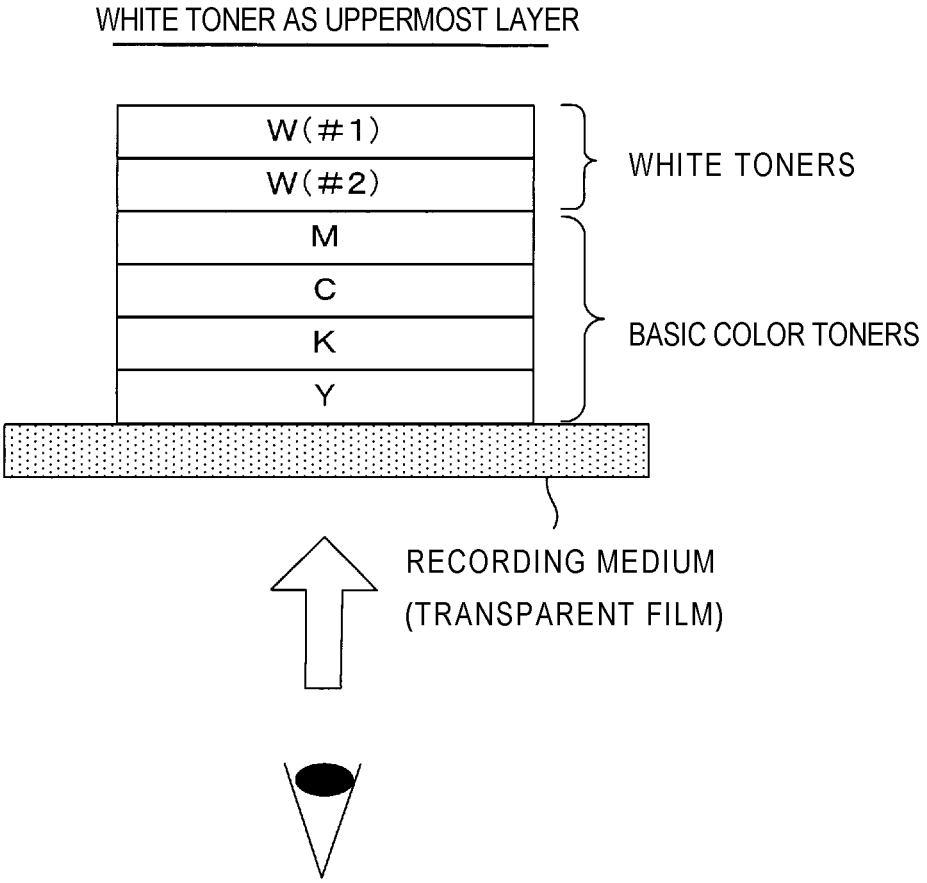
FIG. 12 is a diagram showing a state in which images are formed using the image forming units 12 which are arranged as shown in FIG. 11.

Here, FIG. 12 shows a state in which images are formed using the image forming units 12 which are arranged as shown in FIG. 11.

In FIG. 12, the images of the respective colors are formed in the superimposed manner on the recording medium in an order of yellow (Y), black (K), cyan (C), magenta (M), a white toner (W(#2)), and the white toner (W(#1)). The two special color toners, that is, the white toner (W(#2)) and the white toner (W(#1)) are located in the uppermost layer.

By interchanging the image forming units 12 in this manner, even when an image is visible through the recording medium such as a transparent film, the toner amount of the white toner image formed behind the image is larger than that when an image is formed by only one image forming unit.

It is noted that when the image formation unit 12 is interchanged in the above described manner and the white toner image is formed by the two image forming units 12WA and 12WB, if various settings before the interchanging are left as they are, a problem may arise.

Then, in the image forming apparatus 10 according to the exemplary embodiment, when the white toner image is formed by at least two image forming units 12, a temperature at which the image is heated by the fixing device 36 is set to be higher than that when the white toner image is formed by only one image forming unit 12.

For example, it is assumed that a fixing temperature of the fixing device 36 when the white toner image is formed by only one image forming unit 12 is 160° C. Then, a fixing temperature of the fixing device 36 when the white toner image is formed by the two image forming units 12 is set to, for example, 175° C.

Figure 13A:
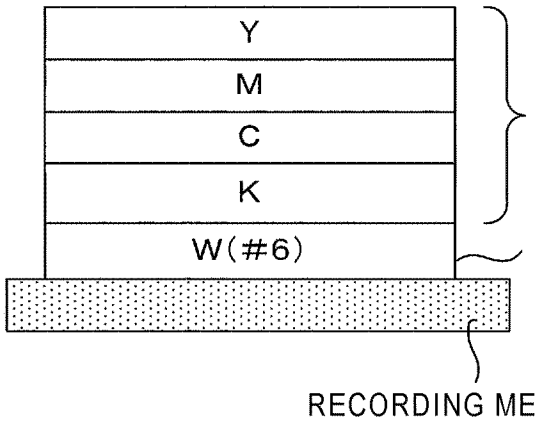
FIGS. 13A and 13B are diagrams showing a reason why a fixing temperature is increased when the white toner images are formed by two image forming units 12.
Figure 13B:
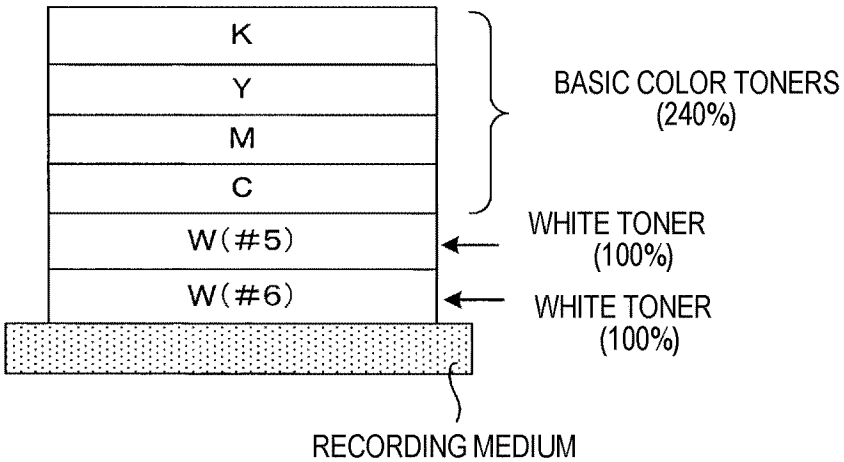

The reason why the fixing temperature is increased when the white toner image is formed by the two image forming units 12 will be described with reference to FIGS. 13A and 13B.

For example, it is assumed that the toner amount when the white toner image is formed is 100%, and that a toner amount when the toner images of the basic colors of CMYK are formed is 240%.

In such a case, when the white toner image is formed by only one image forming unit 12, a total toner amount is 340%, whereas when the white toner image is formed by the two image forming units 12, the total toner amount is 440%.

That is, by forming the white toner image by the two image forming units 12, the total toner amount is increased by 100% as compared with the case where the white toner image is formed by only one image forming unit 12.

Therefore, when the white toner image is formed by the two image forming units 12, the toner amount of an image to be fixed by the fixing device 36 is always increased by 100%, and it is necessary to set a high fixing temperature in order to improve fixing properties.

When at least a part of the plural image forming units 12 which are arranged in the predetermined arrangement order is interchanged, the controller 40 changes a target value of a toner amount of an image formed on the intermediate transfer belt 14 by the image forming unit whose arrangement position is changed from the predetermined arrangement order, based on the changed arrangement position.

Further, when at least the part of the plural image forming units which are arrange in the predetermined arrangement order is interchanged, the controller 40 may calculate a density value of each pixel of the image to be formed by converting a density value before the arrangement order is changed using a predetermined color conversion table such as a look up table (LUT).

Next, the reason why concentrations of the toners of the respective colors are changed when the image forming units 12 which are arranged in the predetermined arrangement order are interchanged in the above described manner will be described below.

When images formed on the photoconductor drums 16 of the image forming units 12 are sequentially transferred to the intermediate transfer belt 14 to form an image as in the image forming apparatus 10 according to the exemplary embodiment, reverse transfer (which is called "retransfer") occurs.

The reverse transfer is a phenomenon in which a part of the toners in the toner images formed on the intermediate transfer belt 14 returns from the intermediate transfer belt 14 to the photoconductor drum 16. The principle of occurrence of such reverse transfer will be described below.

When the toners are held on the intermediate transfer belt 14, the toners are negatively charged by an electric field of the intermediate transfer belt 14. At this time, a toner charge distribution is a normal distribution. When a positive transfer bias is applied to the toners by the primary transfer roller 26, the toner charge distribution becomes flat, and a center of the toner charge distribution moves to the positive side. As a result, the toner is positively charged due to reverse charging, so that the reverse transfer occurs where the toner returns from the intermediate transfer belt 14 to the photoconductor drum 16.

When the toner images of the plural colors are superimposed, the reverse transfer occurs only in the toner image in the uppermost layer. However, when a toner image of another color is not formed on a toner image of a certain color formed on the intermediate transfer belt 14, the reverse transfer occurs in the formed toner image every time a toner image of another color is primarily transferred. That is, a toner image of a color that is formed more upstream on the intermediate transfer belt 14 is more affected by the reverse transfer.

Here, each image forming unit 12 measures a density of a test image formed on the intermediate transfer belt 14, and sets parameters such that the measured value becomes a predetermined target value.

As described above, a toner image of a color that is formed more upstream on the intermediate transfer belt 14 is more affected by the reverse transfer, so that a toner concentration is more decreased. Therefore, in general, the target values are set such that the more upstream an image of a color is formed on the intermediate transfer belt 14, the higher the toner concentration of the color is.

Figure 14:
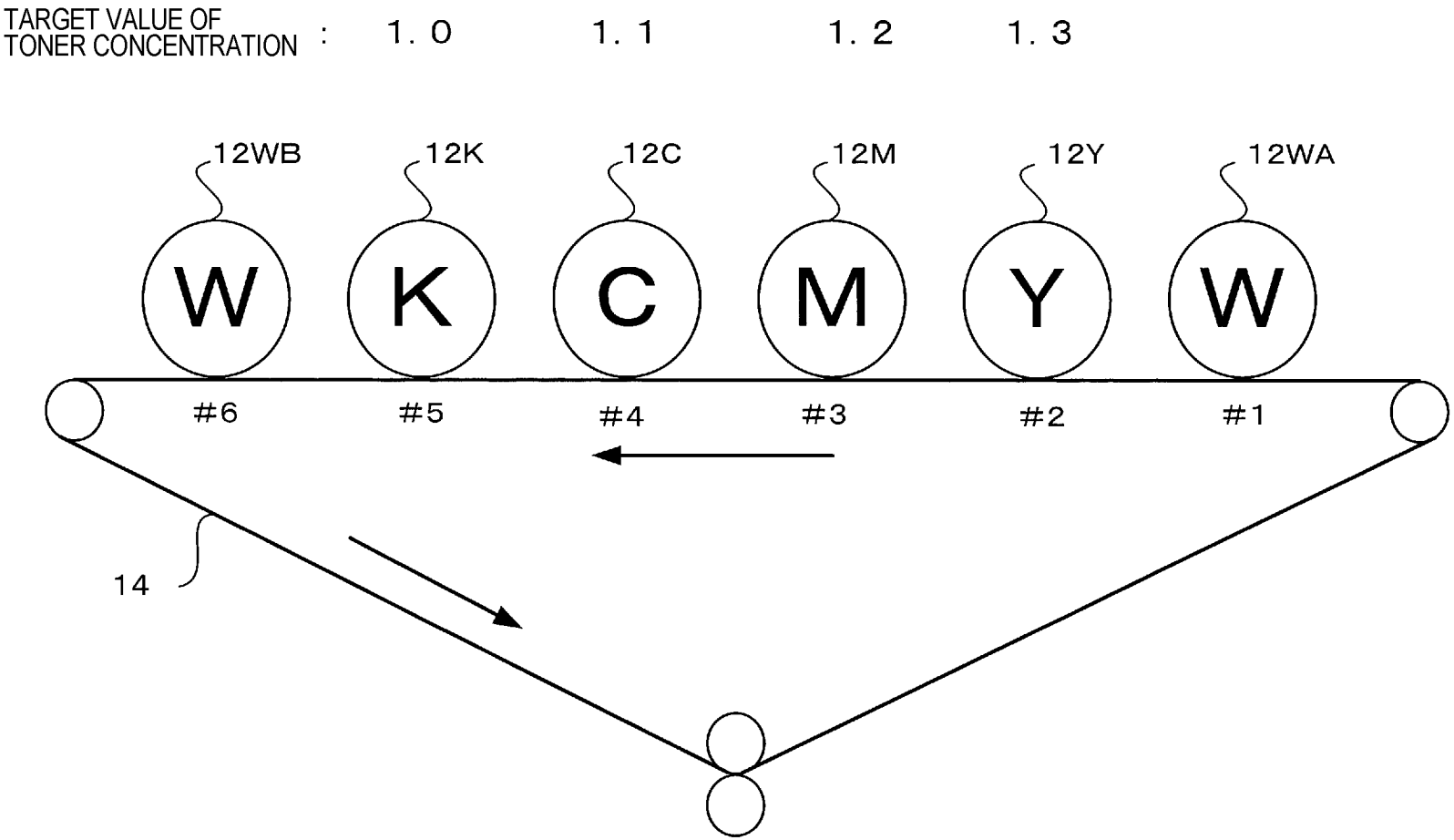
FIG. 14 is a diagram showing an example of target values of toner concentrations set for the arrangement order before the image forming units 12 are interchanged.

For example, when the image forming units 12 are arranged in the predetermined arrangement order before interchanged as shown in FIG. 4, values shown in FIG. 14 are set as the target values of the toner concentrations. Here, the target value shown in FIG. 14 are mere simplified values for facilitating the description, and are different from actual target values.

In FIG. 14, the target values of the toner concentrations of the toners of black, cyan, magenta, and yellow are set to 1.0, 1.1, 1.2, and 1.3, respectively. That is, the target value in the yellow image forming unit 12Y disposed upstream on the intermediate transfer belt 14 is the largest value.

Figure 15:
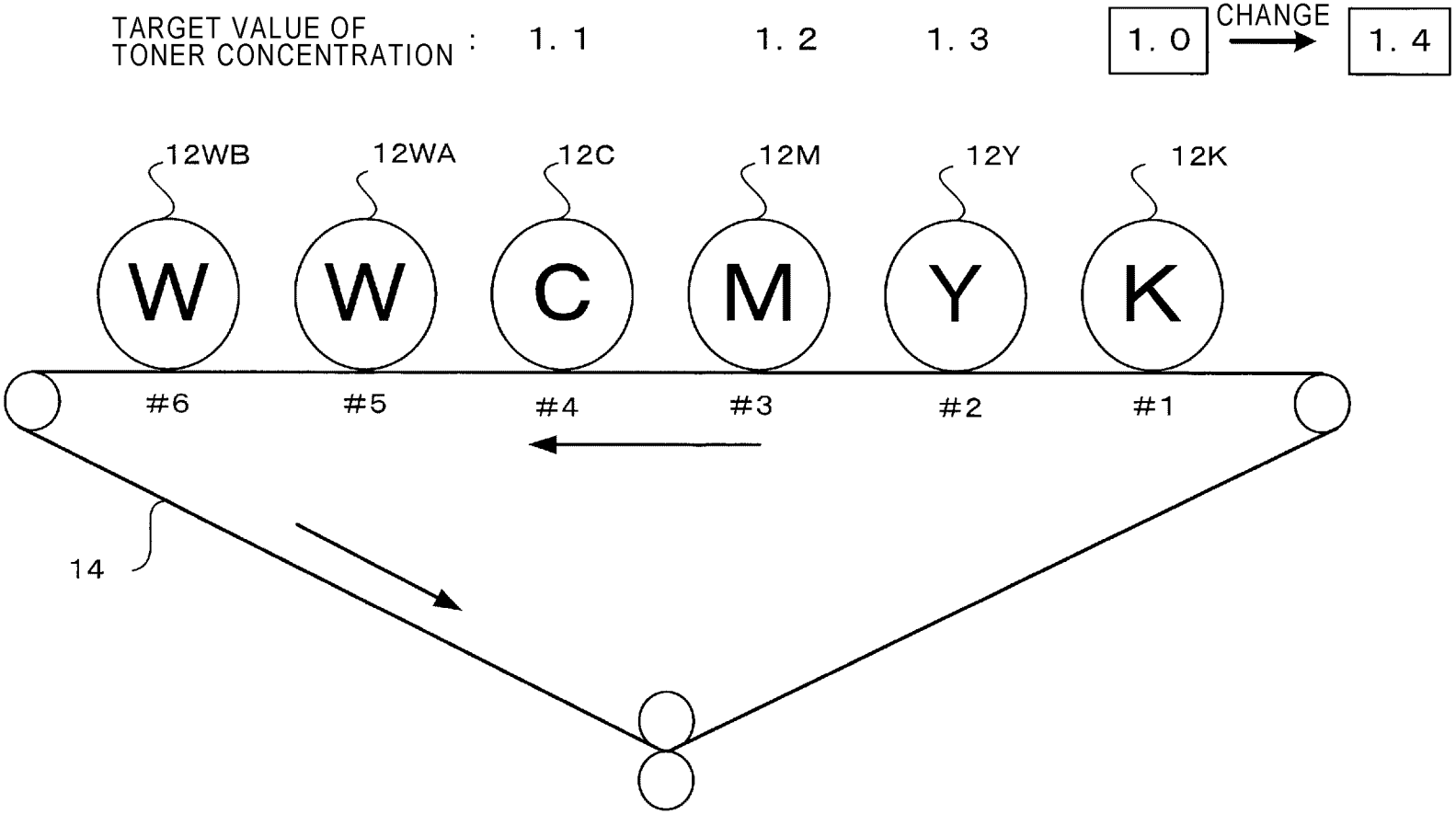
FIG. 15 is a diagram showing an example of changing a target value of a toner concentration when the image forming unit 12WA and the image forming unit 12K are interchanged.

FIG. 15 shows a case where the image forming unit 12WA and the image forming unit 12K are interchanged in a state in which such the target values are set.

Referring to FIG. 15, when the image forming unit 12K is interchanged with the image forming unit 12WA so as to be moved to the position #1 and the target value of the toner concentration remains the same as the original value, it can be seen that the target value of 1.0 is the smallest among those of the other colors of CMY, even though the image forming unit 12K is disposed the most upstream on the intermediate transfer belt 14.

Therefore, it can be seen that when an image is formed in a state in which the target values of the toner concentrations remain as they are, the concentration of the black image may be reduced due to the effect of the reverse transfer.

Therefore, the controller 40 changes the target value of the toner concentration in the image forming unit 12K in which the black toner is set from 1.0 to 1.4. It can be seen that by changing the target value of the toner concentration in this manner, the target value of the toner concentration in the image forming unit 12K is larger than those in the image forming units 12C, 12M, and 12Y of the other colors of CMY.

Figure 16:
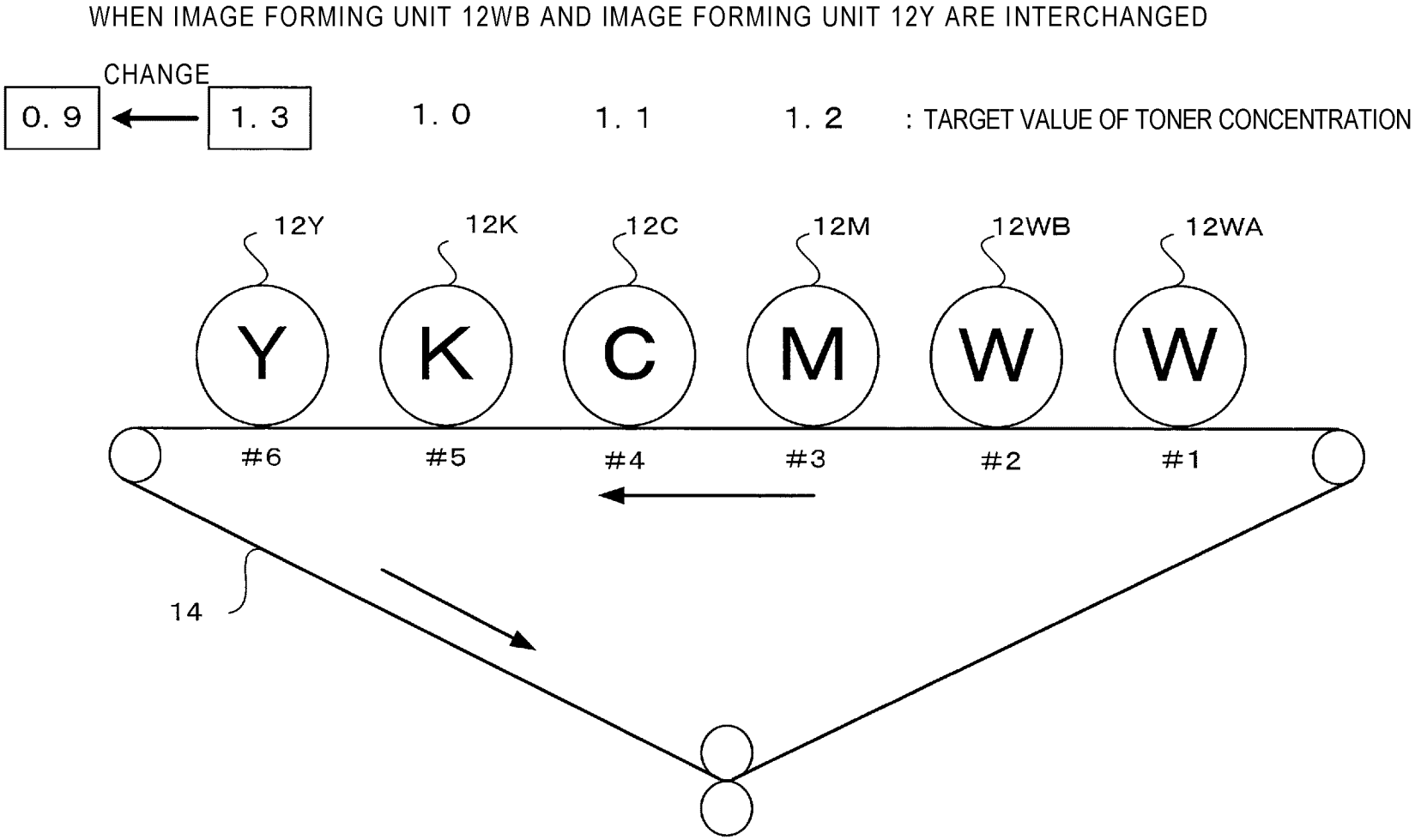
FIG. 16 is a diagram showing an example of changing the target value of the toner concentration when the image forming unit 12WB and the image forming unit 12Y are interchanged.

Further, FIG. 16 shows a case where the image forming unit 12WB and the image forming unit 12Y are interchanged in a state where the target values are set as shown in FIG. 14.

Referring to FIG. 16, when the image forming unit 12Y is interchanged with the image forming unit 12WB so as to be moved to the position #6 and the target value of the toner concentration remains the same as the original value, it can be seen that the target value of 1.3 is the largest among those of the other colors of CMK, even though the image forming unit 12Y is disposed the most downstream on the intermediate transfer belt 14.

Therefore, when an image is formed in a state in which the target values of the toner concentrations remain as they are, the yellow toner image, which would have originally been most affected by the reverse transfer, is least affected by the reverse transfer. Therefore, when the image is formed in the state in which the target values of the toner concentrations remain as they are, the toner concentration of the yellow toner image may be higher than that before the interchanging.

Therefore, the controller 40 changes the target value of the toner concentration in the image forming unit 12Y in which the yellow toner is set from 1.3 to 0.9. It can be seen that by changing the target value of the toner concentration in this manner, the target value of the toner concentration in the image forming unit 12Y is smaller than those in the image forming units 12C, 12M, and 12K of the other colors of CMK.

However, simply changing the target values of the toner concentrations on the intermediate transfer belt 14 in the image forming units 12 of the respective colors based on the arrangement order of the image forming units 12 as described above does not necessarily result in a highly accurate adjustment. That is, depending on the image to be formed, a toner image of another color may or may not be formed on a toner image of a certain color. Therefore, whether and to what extent a toner image formed on the intermediate transfer belt 14 is affected by the reverse transfer depends on the other color images to be formed.

Therefore, in order to reduce influence of changing the arrangement order of the image forming units 12 with high accuracy, it is necessary not only to change the target values of the toner concentrations of the respective colors but also to perform a conversion process, for example, convert CMYK values of each pixel into other CMYK values using a color conversion table such as a four-dimensional LUT.

It is noted that in this case, it is necessary to create the color conversion table in advance in accordance with the changed arrangement order of the image forming units 12.

In the above exemplary embodiment, the two image forming units 12WA and 12WB that form the white toner images are arranged in succession. Alternatively, three or more image forming units 12 that form the white toner images may be arranged in succession.

Figure 17:
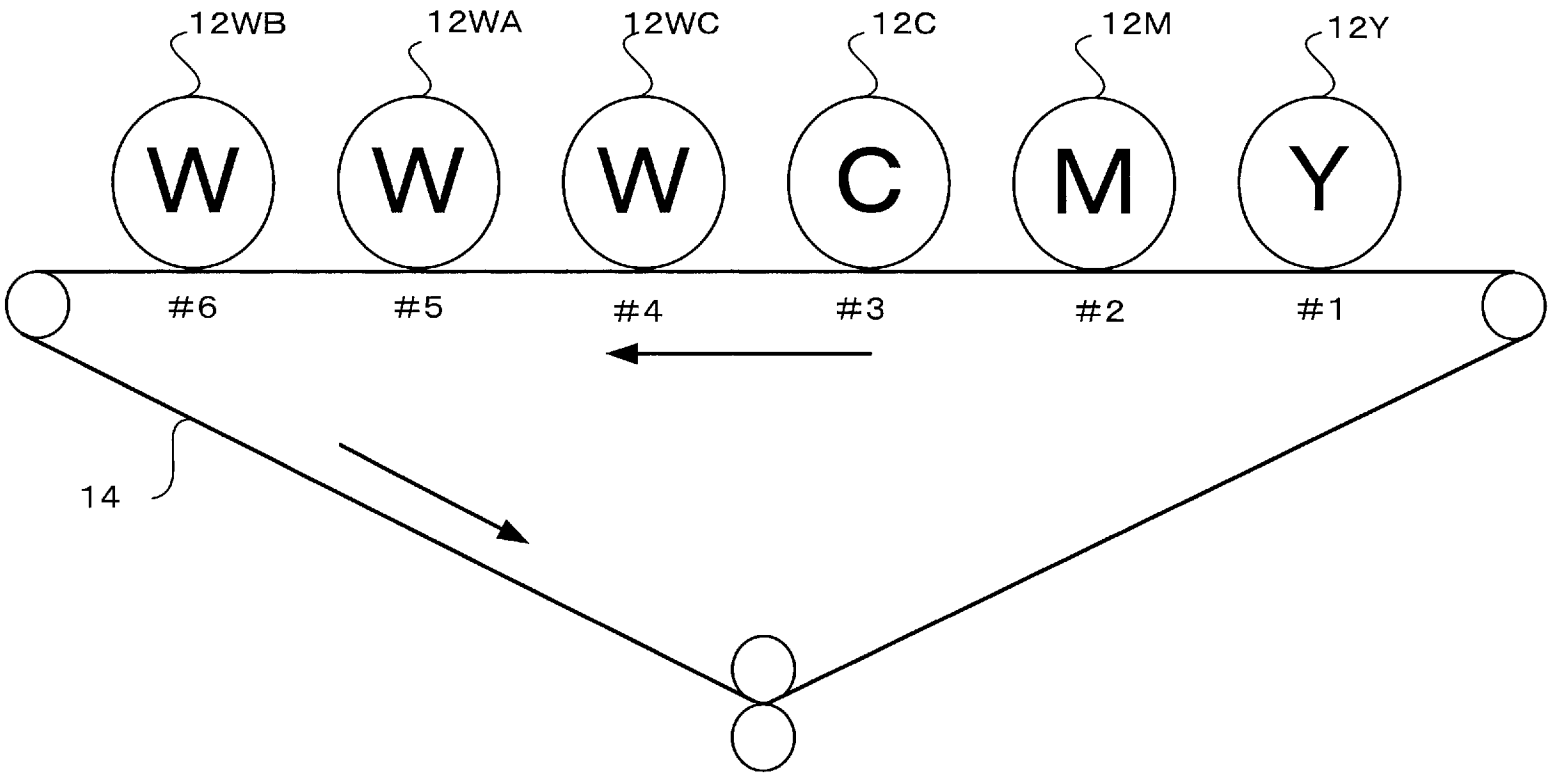
FIG. 17 is a diagram showing a configuration example when three image forming units 12WA, 12WB, and 12WC are arranged in succession.

For example, in the arrangement of the image forming units 12 shown in FIG. 17, three image forming units 12WA, 12WB, and 12WC are arranged in succession. In the configuration shown in FIG. 17, there is no image forming unit 12K that forms a black toner image. However, it is possible to form a full-color image by forming a black image with the CMY color toners.

By increasing the number of image forming units 12 that form the white toner images and that are arranged in succession in this manner, it is possible to form a white image with a higher toner concentration.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

Modified Example

In the above exemplary embodiment, the case where the white toner, which is the special color, is used as a colorant of a color for hiding a base color of the recording medium has been described. It is noted that the present disclosure is not limited thereto. The present disclosure is applicable even to a case where a colorant of a special color other than white is used to hide the ground color of the recording medium. The present disclosure is applicable to not only a case where the base color of the recording medium is hidden, but also a case where an image with a large amount of colorants of special colors is formed such that unevenness of the recording medium is covered with various special colorants such as a gold toner, a silver toner, and a fluorescent color toner to make the unevenness flat.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a plurality of image forming units configured to form images of colors using colorants, respectively; and a controller configured to perform control such that the images formed by the plurality of image forming units are output as one image on a recording medium, wherein at least two of the image forming units are configured to form images using colorants of a same special color and are arranged in succession to form different layers of the same special color, and the controller is configured to control the at least two of the image forming units to form the different layers of the same special color on top of one another.

2. The image forming apparatus according to claim 1, wherein the colorants of the same special color are colorants for hiding a base color of the recording medium.

3. The image forming apparatus according to claim 2, wherein the colorants for hiding the base color of the recording medium are a white colorant.

4. The image forming apparatus according to claim 1, further comprising:

a fixing device configured to heat the images formed by the plurality of image forming units so as to fix the images onto the recording medium, wherein when images are formed with the colorants of the same special color by the at least two of the image forming units, a temperature at which the fixing device heats the images is higher than that when an image is formed with the colorant of one of the same special color by only one of the image forming units.

5. The image forming apparatus according to claim 2, further comprising:

a fixing device configured to heat the images formed by the plurality of image forming units so as to fix the images onto the recording medium, wherein when images are formed with the colorants of the same special color by the at least two of the image forming units, a temperature at which the fixing device heats the images is higher than that when an image is formed with the colorant of one of the same special color by only one of the image forming units.

6. The image forming apparatus according to claim 3, further comprising:

a fixing device configured to heat the images formed by the plurality of image forming units so as to fix the images onto the recording medium, wherein when images are formed with the colorants of the same special color by the at least two of the image forming units, a temperature at which the fixing device heats the images is higher than that when an image is formed with the colorant of one of the same special color by only one of the image forming units.

7. The image forming apparatus according to claim 1, wherein a configuration in which the at least two of the image forming units configured to form the images using the colorants of the same special color are arranged in succession is implemented by interchanging at least part of the plurality of image forming units which are arranged in a predetermined arrangement order.

8. The image forming apparatus according to claim 2, wherein a configuration in which the at least two of the image forming units configured to form the images using the colorants of the same special color are arranged in succession is implemented by interchanging at least a part of the plurality of image forming units which are arranged in a predetermined arrangement order.

9. The image forming apparatus according to claim 3, wherein a configuration in which the at least two of the image forming units configured to form the images using the colorants of the same special color are arranged in succession is implemented by interchanging at least a part of the plurality of image forming units which are arranged in a predetermined arrangement order.

10. The image forming apparatus according to claim 4, wherein a configuration in which the at least two of the image forming units configured to form the images using the colorants of the same special color are arranged in succession is implemented by interchanging at least a part of the plurality of image forming units which are arranged in a predetermined arrangement order.

11. The image forming apparatus according to claim 5, wherein a configuration in which the at least two of the image forming units configured to form the images using the colorants of the same special color are arranged in succession is implemented by interchanging at least a part of the plurality of image forming units which are arranged in a predetermined arrangement order.

12. The image forming apparatus according to claim 6, wherein a configuration in which the at least two of the image forming units configured to form the images using the colorants of the same special color are arranged in succession is implemented by interchanging at least a part of the plurality of image forming units which are arranged in a predetermined arrangement order.

13. The image forming apparatus according to claim 7, wherein when the at least part of the plurality of image forming units which are arranged in the predetermined arrangement order is interchanged, the controller changes a target value of a colorant amount of the image formed by the image forming unit whose arrangement position is changed from the predetermined arrangement order, based on the changed arrangement position.

14. The image forming apparatus according to claim 7, wherein when the at least part of the plurality of image forming units which are arranged in the predetermined arrangement order is interchanged, the controller calculate a density value of each pixel in an image to be formed by converting a density value before the predetermined arrangement order is changed using a predetermined color conversion table.

15. An image forming apparatus comprising:

plural image forming means for forming images of colors using colorants, respectively; and control means for performing control such that the images formed by the plural image forming means are output as one image on a recording medium, wherein at least two of the plural image forming means are configured to form images using colorants of a same special color and are arranged in succession to form different layers of the same special color, and the control means controls the at least two of the image forming units to form the different layers of the same special color on top of one another.

* * * * *